US006361133B1

(12) United States Patent
Carr

(10) Patent No.: US 6,361,133 B1
(45) Date of Patent: Mar. 26, 2002

(54) METHOD AND APPARATUS FOR CONSTRUCTING A TURNDOWN PAD

(75) Inventor: Jeffery N. Carr, Johnstown, PA (US)

(73) Assignee: Dynacom Industries, Inc., Johnstown, PA (US)

( * ) Notice: Subject to any disclaimer, the term of this patent is extended or adjusted under 35 U.S.C. 154(b) by 0 days.

(21) Appl. No.: 09/240,243

(22) Filed: Jan. 29, 1999

(51) Int. Cl.[7] ..... A47B 91/00

(52) U.S. Cl. ..... 312/351.2; 312/223.1; 248/346.1

(58) Field of Search ..... 312/265.6, 351.1, 312/351.2, 223.2, 223.1, 223.6, 111, 100, 213, 236; 108/56.3, 25, 901, 26, 44, 50.02, 55.3, 50.11, 53.3; 248/346.01, 678; 220/3.94, 4.02, 3.8

(56) References Cited

U.S. PATENT DOCUMENTS 2,542,173 A * 2/1951 Wolf ..... 312/236
2,683,639 A * 7/1954 Breeny ..... 108/161
2,909,043 A * 10/1959 Baker et al. ..... 312/213
3,192,306 A * 6/1965 Skonnord ..... 312/213
5,076,461 A * 12/1991 Nichols ..... 312/223.1
5,327,838 A * 7/1994 Beltman ..... 108/25

FOREIGN PATENT DOCUMENTS

FR 2762029 10/1998
GB 2326028 12/1998

OTHER PUBLICATIONS

Publication by Lucent Technologies entitled, "Cabinet Enhancement Services," 3 pages.

* cited by examiner

*Primary Examiner*—Peter R. Brown
*Assistant Examiner*—Jerry A. Anderson
(74) *Attorney, Agent, or Firm*—Cohen & Grigsby, P.C.

(57) ABSTRACT

A turndown pad having a body (10) with panels (102, 104, and 106) that are received in respective openings (82, 84 and 86) of body (10) and also having covers (118 and 120) that are received in openings (88 and 90) of body (10). Panels (102, 104, and 106) are selected from corresponding families of panels with each family of panels defined by a common profile shape and size. The different members of each family of panels (102, 104 and 106) have selected arrangements of holes (110, 112, and 114) respectively so that different combinations of panels provide different combinations of holes (110, 112, and 114).

6 Claims, 5 Drawing Sheets

METHOD AND APPARATUS FOR CONSTRUCTING A TURNDOWN PAD

BACKGROUND OF THE INVENTION

1. Field of the Invention

The subject invention relates to methods and apparatus for installing and modifying electrical and electronic equipment and, more specifically, methods and apparatus for preassembly and installation of communications networks.

2. Description of the Prior Art

Communications systems have been under continual development for many years. More recently, developments relating to various communication media, including fiberoptic, microwave, and electrical networks, have accelerated the rate at which communications systems as well as other information and control systems are being revised and improved.

To utilize these continued advances in technology, it has become necessary for both users and providers of these systems to more frequently update and improve the system components. This has resulted in more frequent and often more technically complex modifications and improvements than have been previously required.

The increasing complexity of communications systems and other affected systems and the somewhat delicate nature of the system components also has made installation of the system improvements increasingly more costly. Moreover, the environment in which many installations are performed has often made such field installations more vulnerable to human errors and component failures.

Accordingly, in the prior art there have been various attempts to curtail the cost and difficulty associated with the installation of complex or physically delicate communications systems. Such attempts have included various designs and methods for constructing communications systems such that they will be less susceptible to difficulties and complications of the type that frequently arise in field construction and assembly of such systems. These designs and methodologies include those in which substantial portions of the assembly are completed in a more controlled environment such as a fabrication or assembly shop and the assembled portion shipped to the construction site for final installation.

With particular regard to communications systems, one improvement has been the use of turndown pads in connection with the assembly and installation of new or replacement communications systems. Specifically, a turndown pad was developed that would provide for the mechanical, electrical, and optical connection of various communications systems components. In particular, the turndown pads provided for connections between a digital loop carrier cabinet ("DLC cabinet") which provides digital telephone services, a "power pedestal" which connects the main power service to the DLC cabinet, and a "cross-connect panel" which connects the telephone service from the DLC to individual telephone customers. The turndown pad allowed the most complex and difficult interconnections between the DLC cabinet, the power pedestal, and the cross-connect panel to be installed inside the turndown pad at an assembly shop. The turndown pad was then delivered to the Job site where it was mechanically joined with the DLC cabinet, the power pedestal, and the cross-connect panel. Thus, the only connections that were required in the field were the splices and cutovers that were required between the cabinets and the cutovers that were required with respect to inputs and outputs to the network.

One difficulty with the prior turndown pad system arose in part from the fact that there are a number of suppliers of the various cabinet components of the network, but there is no standardization for the dimensions and configurations of the various cabinets. This has meant that the electrical interconnections and the mechanical connections that are required to secure the cabinets to the turndown pad vary in accordance with the particular cabinets and combination of cabinets that are used at a particular installation. The diversity between cabinets is such that no standardized or universal connection has been developed in the prior art. The number and variety of available cabinets is sufficiently large that the number of possible combinations of cabinets is quite large. This in turn has required that, to control inventory costs of the turndown pads, the turndown pads have been fabricated on a made to order basis.

Another difficulty with the prior turndown pads has been that they have generally been fabricated out of concrete. Fabricating concrete turndown pads on a made to order basis has required significant fabrication time. The concrete forming process is relatively slow and is inherently limited by the rate at which the concrete will cure. Concrete turndown pads are also relatively heavy and therefor somewhat difficult and unsafe to transport and manipulate. Typically, such concrete turndown pads weigh approximately 22,000 pounds or more.

Accordingly, there was a need in the prior art for an improved turndown pad that had mechanical strength and rigidity that was sufficient to support the various cabinets, but that also was lighter and more easily moved and manipulated than the concrete turndown pads that were know in the prior art. Also, there was a need for a turndown pad that could be fabricated more rapidly and with greater flexibility than the prior turndown pads.

SUMMARY OF THE INVENTION

In accordance with the subject invention, a turndown pad includes a base that defines a plurality of openings with each of the openings having a predetermined profile and size. The turndown pad further includes a plurality of panels that have profiles corresponding to respective openings in the base. The panels have selected arrangements of holes therein and cooperate with the base such that they are received in the respective openings of the base. The turndown pad also includes at least one cover that has a profile that corresponds to a selected opening in said base.

Preferably, each of the panels are selected from a corresponding family of panels wherein all of the panels of a given family are defined by a profile having a given size and shape. Each member panel of a family of panels has at least one hole therein with the size, shape and arrangement of said holes defining the different members of the family of panels.

More preferable, the base and panels of the turndown pad are comprised of composite material and said base is further provided with an internal support frame.

Other features, objects and advantages of the subject invention will become apparent to those skilled in the art as a description of a presently preferred embodiment of the invention proceeds.

BRIEF DESCRIPTION OF THE DRAWINGS

A presently preferred embodiment of the invention is shown and described in connection with the accompanying drawings wherein.

PREFERRED EMBODIMENT OF THE INVENTION

Figure 1:
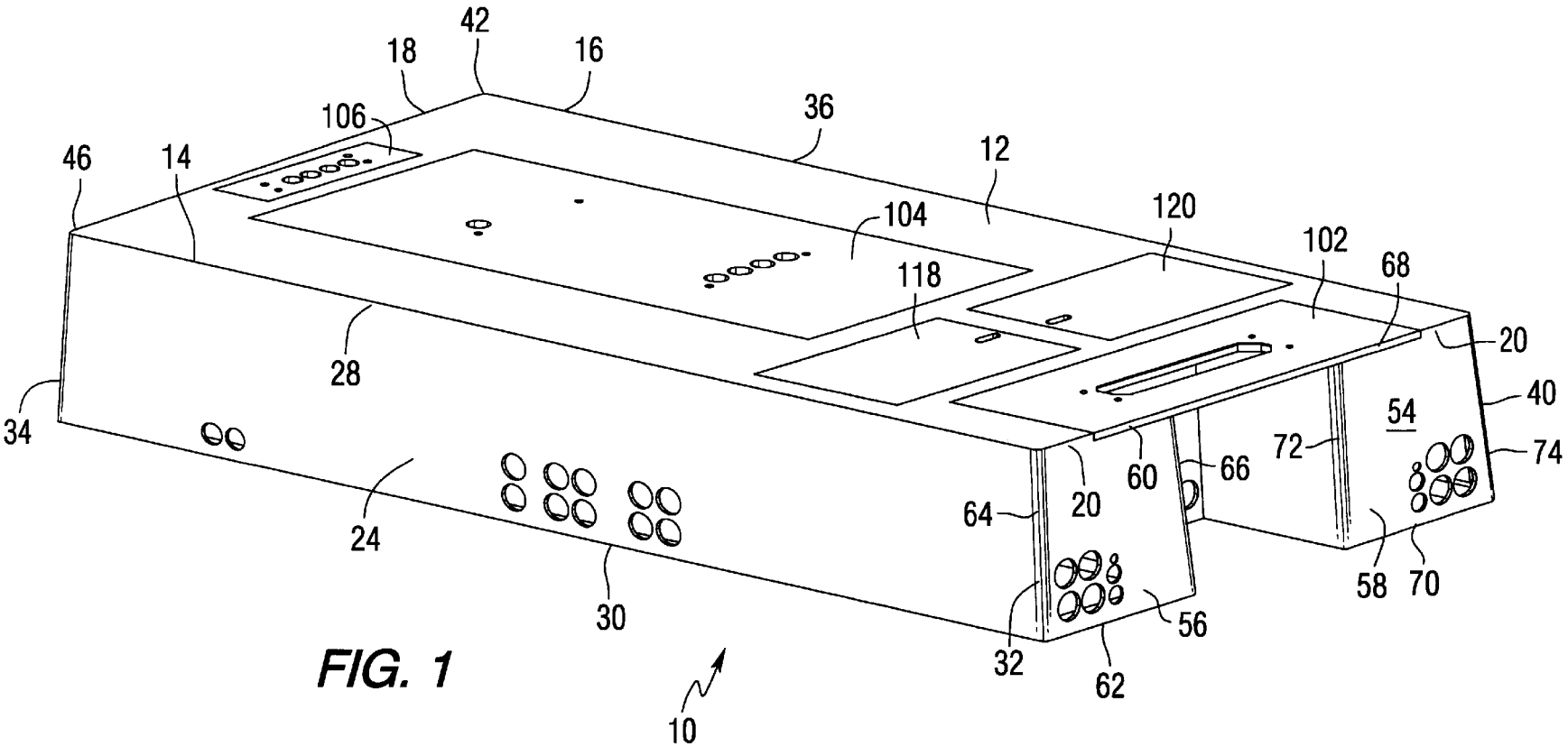
FIG. 1 is an assembly view of the turndown pad disclosed herein.
Figure 2:
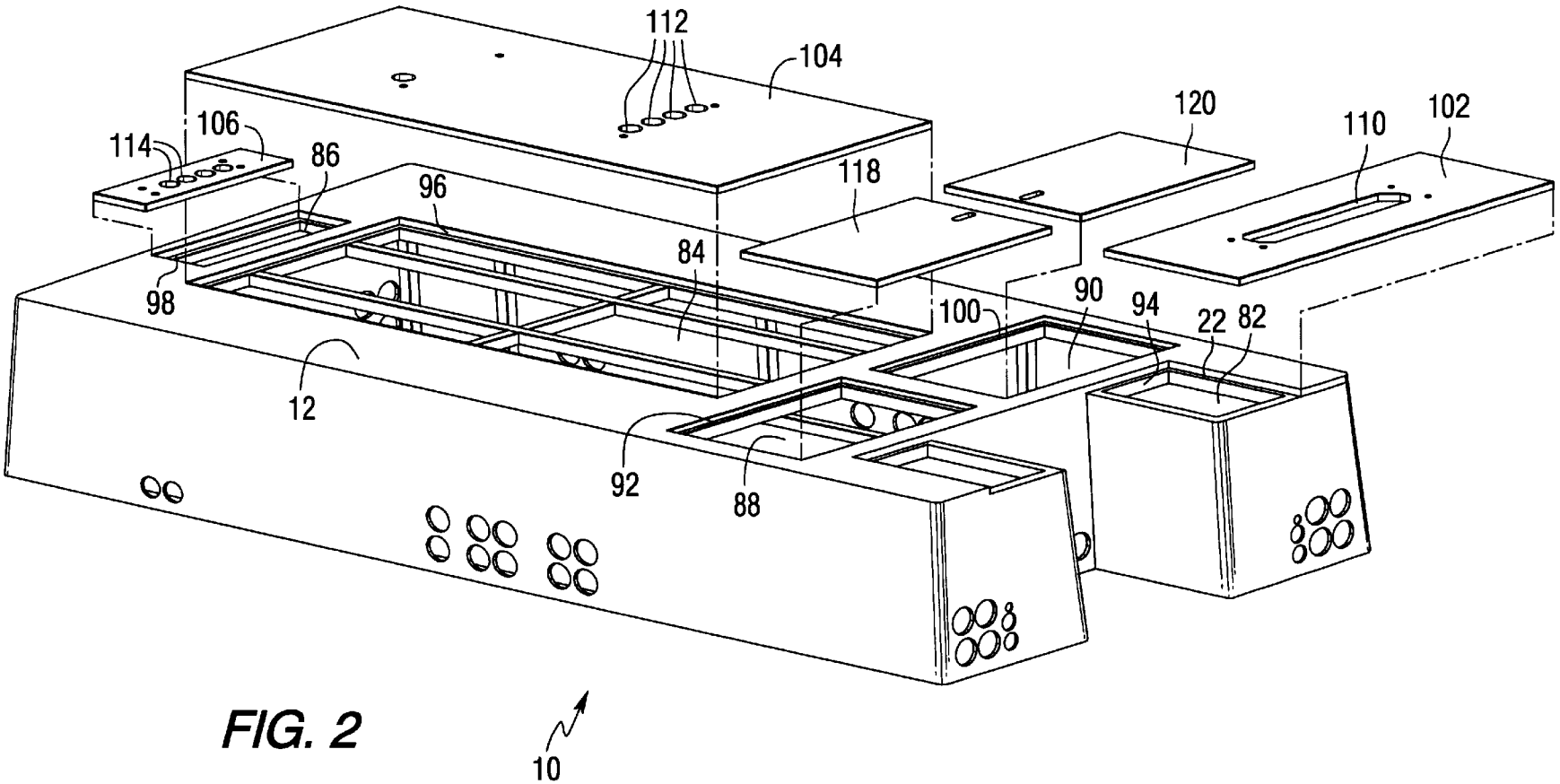
FIG. 2 is an exploded assembly view of the turndown pad shown in FIG. 1.
Figure 3:
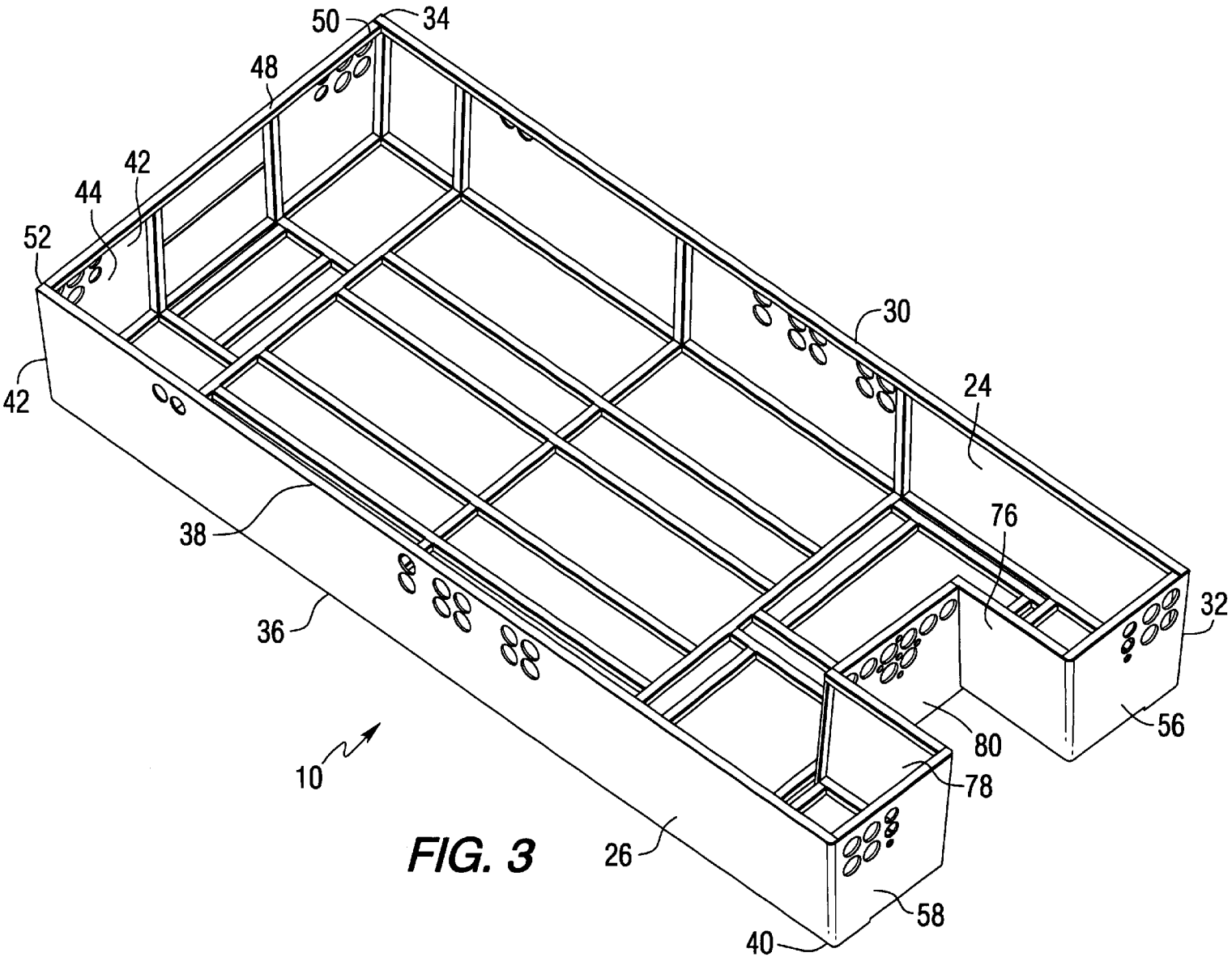
FIG. 3 is a bottom isometric view of the turndown pad shown in FIG. 1.

With particular reference to FIGS. 1–3, a turndown pad includes a base 10 that has a generally rectangular shape. Base 10 includes a top planar member 12 having first and second side boundaries 14 and 16 respectively with side boundaries 14 and 16 being substantially parallel to each other. Top planar member also has a first end boundary 18 that is generally orthogonal with respect to side boundaries 14 and 16. Top planar member 12 also has a second end boundary 20 that is substantially parallel to end boundary 18 and oppositely disposed on top planar member therefrom.

Base 10 further includes sidewalls 24 and 26 that have a generally trapezoidal shape. Sidewall 24 has a minor parallel edge 28, a major parallel edge 30, and converging edges 32 and 34. Edges 28 and 30 are substantially parallel to each other. Converging edges 32 and 34 are non-parallel to each other and are in substantially the same plane as edges 28 and 30. Converging edges 32 and 34 are aligned on intersecting lines and intersect edges 28 and 30 such that minor parallel edge 28 is shorter than major parallel edge 30.

Sidewall 26 has a minor parallel edge 36, a major parallel edge 38, and converging edges 40 and 42. Edges 36 and 38 are substantially parallel to each other. Converging edges 40 and 42 are non-parallel to each other and are in substantially the same plane as edges 36 and 38. Converging edges 40 and 42 are aligned on intersecting lines and intersect edges 36 and 38 such that minor parallel edge 36 is shorter than major parallel edge 38.

The minor parallel edges 28 and 36 of sidewalls 24 and 25 are connected to top planer member 12 at side boundaries 14 and 16 respectively. Similar to the sidewalls 24 and 26, an endwall 44 has a generally trapezoidal shape with a minor parallel edge 46, a major parallel edge 48, and two converging side edges 50 and 52. Edges 46 and 48 are substantially parallel to each other. Converging edges 50 and 52 are non-parallel to each other and are in substantially the same plane as edges 46 and 48. Converging edges 50 and 52 are aligned on intersecting lines and intersect edges 46 and 48 such that minor parallel edge 46 is shorter than major parallel edge 48. The side edges 50 and 52 of endwall 44 are connected to the side edges 34 and 42 of sidewalls 24 and 26 respectively.

Adjacent to second end boundary 20, a second endwall 54 is also provided. Endwall 54 includes two trapezoidal-shaped sections 56 and 58. Section 56 has a minor parallel edge 60, a major parallel edge 62, and converging side edges 64 and 66. Edges 60 and 62 are substantially parallel to each other. Converging edges 64 and 66 are non-parallel to each other and are in substantially the same plane as edges 60 and 62. Converging edges 64 and 66 are aligned on intersecting lines and intersect edges 60 and 62 such that minor parallel edge 60 is shorter than major parallel edge 62.

Section 58 has a minor parallel edge 68, a major parallel edge 70, and converging side edges 72 and 74. Edges 68 and 70 are substantially parallel to each other. Converging edges 72 and 74 are non-parallel to each other and are in substantially the same plane as edges 68 and 70. Converging edges 72 and 74 are aligned on intersecting lines and intersect edges 68 and 70 such that minor parallel edge 68 is shorter than major parallel edge 70.

Sections 56 and 58 are connected to second end boundary 20 at minor parallel edges 60 and 68 respectively. Side edge 64 of section 56 is connected to edge 32 of sidewall 24 and side edge 74 of section 58 is connected to edge 40 of sidewall 26. Endwall 54 further includes an offset section that is formed by two lateral sections 76 and 78 that are joined to a common end section 80. Lateral sections 76 and 78 and end section 80 are also generally trapezoidal in shape in the manner of sidewalls 24 and 26 and endwall 44.

The connection of sidewalls 24 and 26 and endwalls 44 and 54 at converging edges as more particularly described above results in sidewalls 24 and 26 and endwall is 44 and 54 being connected to top planar member 12 in a non-orthogonal orientation. The major parallel edges of sidewalls 24 and 26 and endwalls 44 and 54 circumscribe a larger area than the area enclosed by the corresponding minor parallel edges. In this way base 10 of the turndown pad at locations laterally away from top planar member 12 encompasses a surface area that is larger than the major surface of top planar surface 12 which is between boundaries 14, 16, 18 and 20.

This configuration of top planar surface 12, sidewalls 24 and 26, and endwalls 44 and 54 has been found to make the turndown pad more stable and rigid. With this structure, sidewalls 24 and 26 and endwalls 44 and 54 of a given material strength support greater vertical loading than sidewalls and endwalls of the same material when such sidewalls and endwalls are oriented in substantially orthogonal relationship with respect to top planar surface 12.

As shown in FIGS. 1–3, sidewalls 24 and 26 and endwalls 44 and 54 are provided with holes at various locations therein. The purpose of these holes is to afford passage of input and output lines (not shown) at the time that the turndown pad is installed in the field.

As shown more particularly in FIG. 2, top planar member 12 defines a plurality of openings 82, 84, 86, 88, and 90 that have respective profiles. Openings 82, 84, 86, 88 and 90 have corresponding perimeter ledges 92, 94, 96, 98 and 100. Each of openings 82–90 has a predetermined profile and preselected dimensions. In the example of the preferred embodiment, the profiles of openings 82–90 are generally rectangular although other profiles or shapes, including rectangles in different proportions, are within the scope of the invention disclosed herein.

Figure 4:
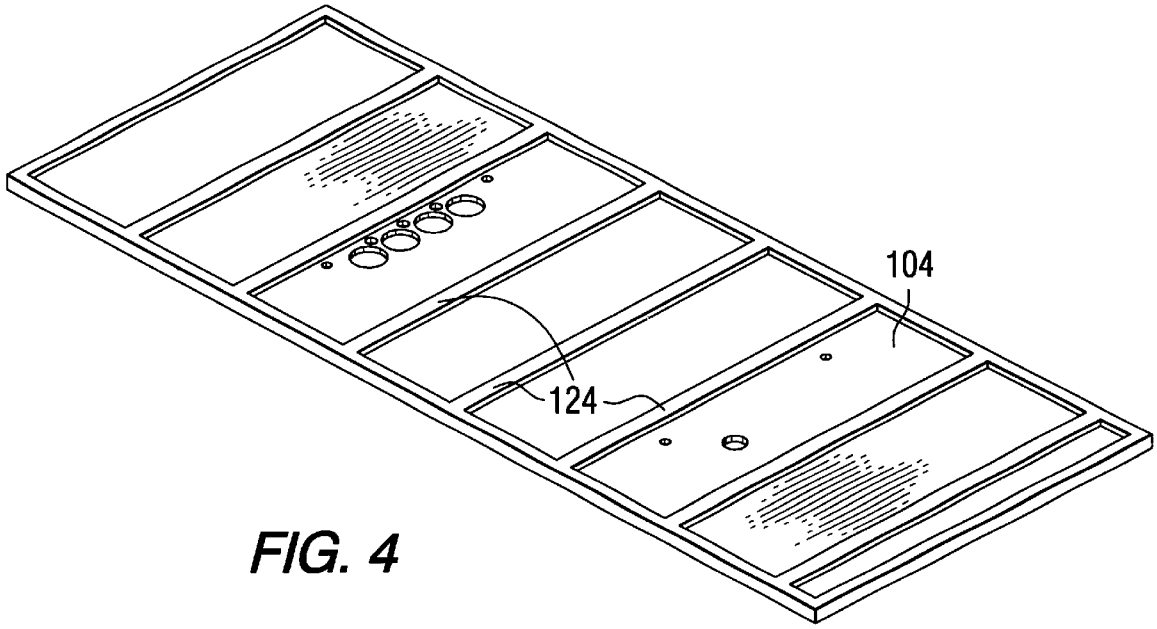
FIG. 4 is a bottom view of the DLC insert panel that is shown as part of the turndown pad of FIGS. 1 and 2.
Figure 5:
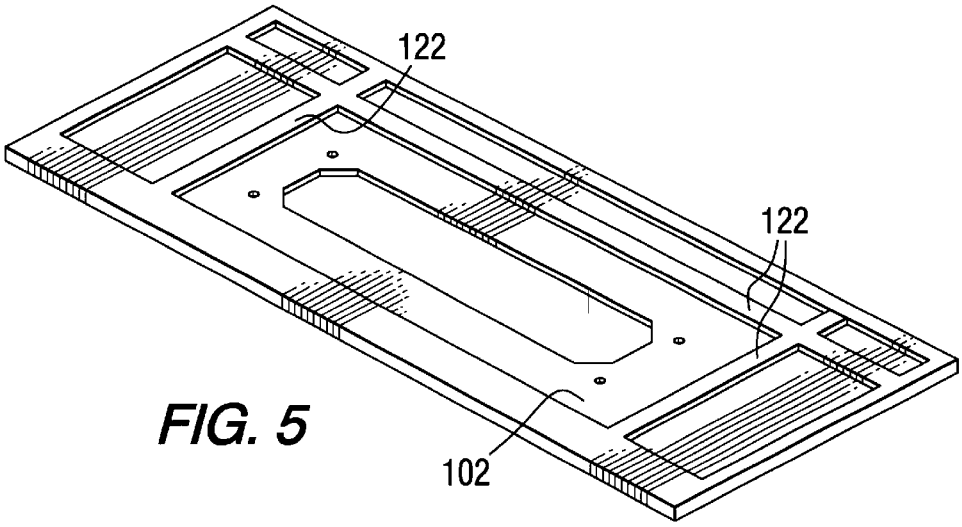
FIG. 5 is a bottom view of the cross-connect cabinet panel that is shown as part of the turndown pad of FIGS. 1 and 2.
Figure 6:
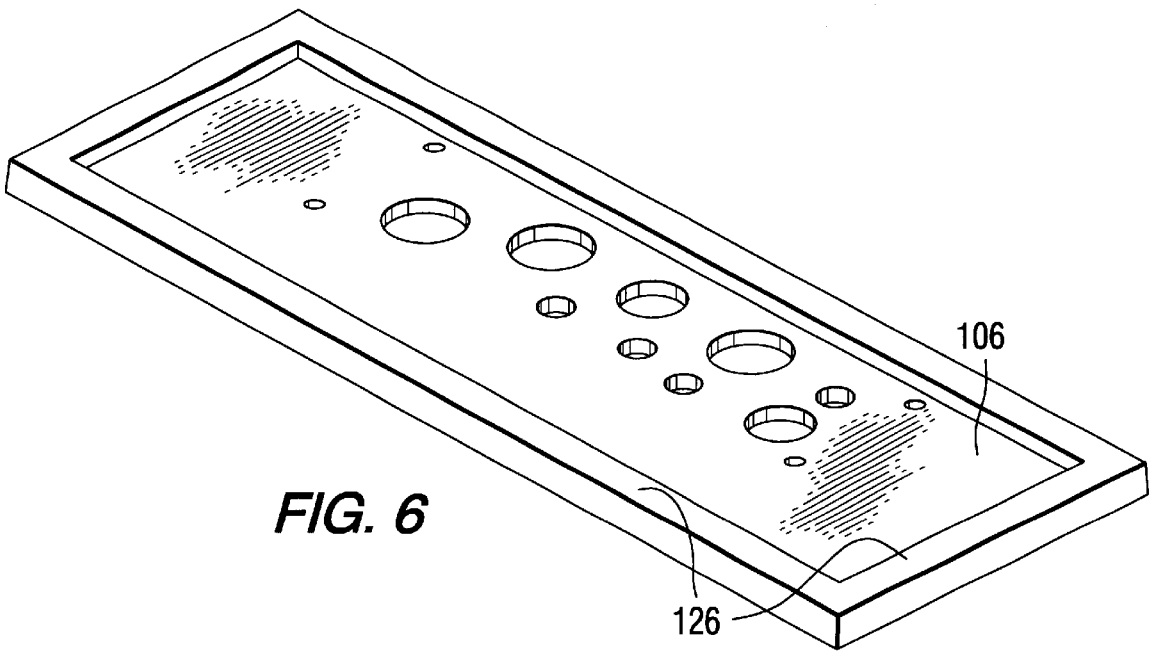
FIG. 6 is a bottom view of the power pedestal cabinet panel that is shown as of the turndown pad of FIGS. 1 and 2.

As also shown in FIGS. 1 and 2, the turndown pad disclosed herein further includes a plurality of panels 102, 104, and 106. In particular, the preferred embodiment discloses cross-section panel 102, DLC panel 104, and power pedestal panel 106, which are further shown in FIGS. 4, 5 and 6. As depicted in the drawings, each of panels 102–106 defines one or more holes 110, 112, and 114. The size and particular arrangement of holes 110–114 is largely determined according to the specifications of the particular cabinet (not shown) with which the respective panels are to be installed.

As previously explained herein, the turndown pad is used in connection with a large number of various cabinets that have different specifications concerning the location and arrangement of holes and anchors for securing the cabinets to the turndown pad. To meet this demand for wide variation, families of panels are designed and fabricated to meet each of the variable specifications for hole location and arrangement as well as for anchor types which correspond to each make and model of cabinet.

The size and arrangement of holes 110–114 is predetermined according to the particular cabinets that are to be used at the point of installation. However, the selection and combination of these cabinets is not known at the time that panels 102–106 are fabricated. Therefore, in accordance with the invention herein disclosed, a separate family of panels is fabricated for each of panels 102–106.

Each member of a family of panels is defined by substantially the same profile as all of the other panels in the same family. Each member panel of a family of panels has a unique arrangement of holes and mounting attachments that correspond to the specifications of a particular cabinet. For each panel in a family of panels however, the outer perimeter shape and dimensions are substantially the same. Thus, each panel 102 in the family of cross-connect panels is received in opening 82 with panel 102 engaging the perimeter ledge 94 of opening 82. Similarly, each panel 104 in the family of DLC panels is received in opening 84 with panel 104 engaging the perimeter ledge 96 of opening 84 while each panel 106 in the family of power pedestal panels is received in opening 86 with panel 106 engaging the perimeter ledge 98 of opening 86. In this way, panels 102, 104, and 106 can be selected as required for the particular application and assembled with the body of turndown pad.

Since all of the panels in a family of panels have the same profile and the same nominal dimensions, any member of the family will cooperate with top planar member 12 to close a respective opening. In this way, the turndown pad can be fabricated from the combination of panels that are selected from the corresponding panel families according to the particular selection and combination of cabinets that are specified to the fabricator.

The apparatus and method for fabrication of the turndown pad as herein disclosed allows the fabricator to inventory a limited number of turndown pad bodies 10 having differing sizes and styles. The body can be quickly and easily fabricated to accommodate any combination of cabinets though selection of the appropriate panel member from each family of panels. This structure and method of fabrication is advantageous in that all of the various combinations of required hole configurations for panels 102–106 can be pre-designed and pre-fabricated for assembly. This is in contrast to turndown pads of the prior art wherein the turndown pad was of one integral design so that the particular combination of cabinets had to be known before the design could be completed and fabrication thereof begun.

Furthermore, this method and structure of fabrication is advantageous in that material inventories are greatly reduced. From a material usage standpoint, the greater portion of the turndown pad is required to fabricate the body 10 portion of the turndown pad. The several families of panels require significantly less material to make. Therefore, in accordance with the disclosed structure and method, it is possible to maintain adequate inventories to meet a broad variety of customer specifications by having a relatively few turndown pad bodies and complete sets of the various families of panels. Any of the bodies can be assembled to meet user specifications by selecting the appropriate panels and then assembling those panels together with the body.

In accordance with the preferred embodiment that Is herein disclosed, the turndown pad is composed of a composite material. This material can be formed and cured relatively quickly is comparison to many conventional building materials such as concrete or similar materials. Also, composite material is substantially lighter in weight than many alternative construction materials. For example, a turndown pad constructed of concrete in accordance with prior art designs typically weighed 22,000 pounds or more! In contrast, the turndown pad made in accordance with the disclosed invention weighs only about 2,400 pounds. This difference in weight makes the turndown pad disclosed herein much easier to manipulate and transport in comparison to turndown pads of the type known in the prior art.

As best shown in FIG. 3, although a body and panels of composite material would be strong enough for many applications without the use of additional support, the example of the preferred embodiment further includes a steel frame 116 that is located internally in body 10 of the turndown pad. Frame 116 can be composed of steel tubing having a square cross-section or other commercially available material. Frame 116 can be secured to the interior surfaces of the turndown pad body, but it can also be sized to engage the interior surfaces of the body and panels of the turndown pad so as to operate as an internal skeletal support structure.

Figure 7:
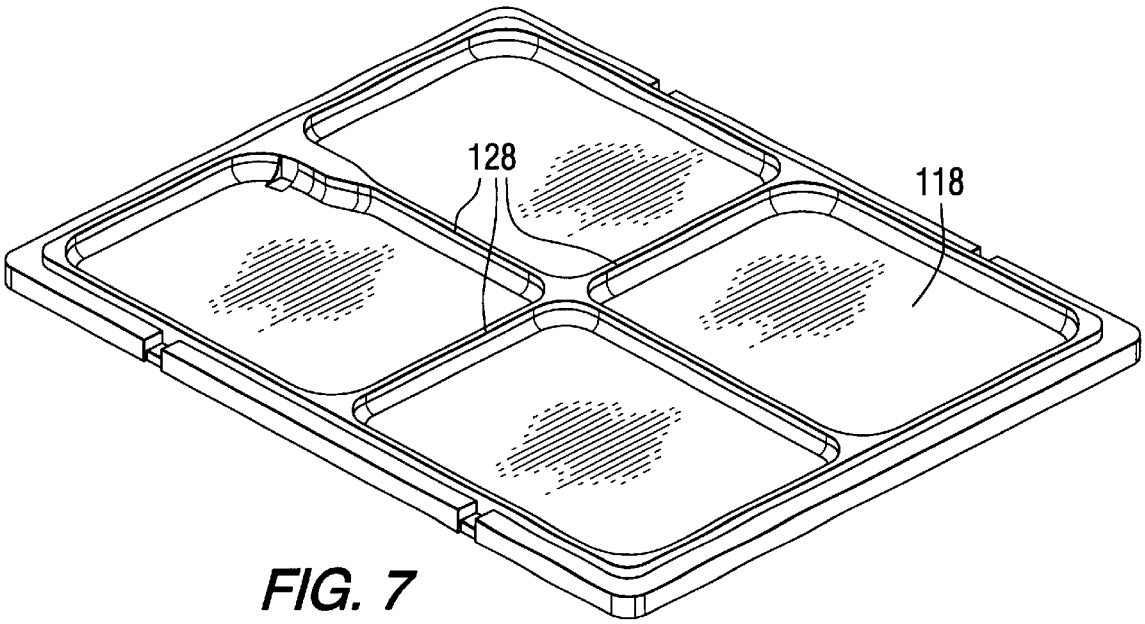
FIG. 7 is a bottom view of the splice hatch cover that is shown as part of the turndown pad of FIGS. 1 and 2.

Referring to FIGS. 1, 3 and 7, openings 88 and 90 in top member 12 are provided as means for ingress and egress to and from the interior of the turndown pad body during installation and also during periods of maintenance. Openings 88 and 90 are defined by perimeter ledges 98 and 100 respectively. Splice hatch covers 118 and 120 are provided for closing openings 88 and 90 at times when access to the interior of the turndown pad body is not needed. In the manner similar to the panels 102–106, the splice hatch covers 118 and 120 have a shape and dimension such that they engage the perimeter ledges 98 and 100 of the respective openings 88 and 90.

In the preferred embodiment, panels 102–106 and hatch covers 118–120 are also comprised of composite material. As shown in FIGS. 4–7, to further increase the lateral strength of panels 102–106 and covers 118–120, each of the panels and covers are further provided with internal ribs 122, 124, 126, and 128 respectively. These internal ribs 122–128 have been found to be useful in increasing the load bearing capacity of panels 102–106 and covers 118–120. Panels 102–106 and covers 118–120 could be made from metal or other building material, but composite is preferred because it is highly resistant to corrosion, spalling and other deleterious processes.

While a presently preferred embodiment of the presently disclosed invention and the presently preferred method of practicing the same are shown and described herein, it will be apparent to those skilled in the art that the invention can be otherwise variously embodied within the scope of the following claims.

I claim:

1. A structure for housing electrical and electronic equipment and for supporting a combination of electrical cabinets that have electrical and mechanical connectors, with the electrical and mechanical connectors of different cabinets being differently configured, said structure comprising:

a base that has interior surfaces, said base defining a plurality of openings, each of said openings having a perimeter that defines a respective profile shape and dimensions;

a plurality of panels made of composite material, each of said panels being associated with a respective electrical cabinet, said panels having holes therein with said holes of different panels being situated at different locations in correspondence with the associated respective electrical cabinet, each of said panels also having a profile shape and dimensions such that said panel corresponds with the profile shape and dimensions of at least one opening of the base and engages the perimeter of a selected one of said openings in said base; and a cover that is made of composite material and that has a shape and dimensions such that the cover engages the perimeter of at least one of said openings in said base.

2. The structure of claim 1 further comprising:

a metal frame that is located inside said base and that is secured to the interior surfaces of said base, said frame providing internal skeletal support for said base.

3. The structure of claim 1 wherein said base includes at least one sidewall that has a base edge, a top edge that is generally parallel to said base edge, and non-orthogonal edges between said top edge and said base edge such that the perimeter of said sidewalls defines a trapezoidal shape, and wherein said base further includes at least one endwall that has a base edge, a top edge that is generally parallel to said base edge, and non-orthogonal edges between said top edge and said base edge such that the perimeter of said endwall defines a trapezoidal shape, said sidewall and said endwall being connected together along one of the non-orthogonal sides of the sidewall and the endwall such that the perimeter of said structure is larger at said base edge than the perimeter of said structure at said top edge.

4. A turndown pad for housing electrical and electronic equipment and for supporting a variety of electrical cabinets with each electrical cabinet of said variety of electrical cabinets having electrical and mechanical connectors, the electrical and mechanical connectors of different electrical cabinets in said variety of electrical cabinets being differently configured, said structure comprising:

a base that defines a plurality of openings, each of said openings having a perimeter that defines a respective profile shape and size;

a plurality of panels made of composite material, each of said panels corresponding to a respective one of the plurality of openings that are defined by the base, at least one of said panels being selected from a family of panels wherein each member of the family of panels has substantially the same profile and wherein each member of the family of panels has holes and mounting hardware that are situated at different locations with respect to other members of the family of panels and wherein each member of the family of panels is in correspondence with a particular electrical cabinet, each panel within said family of panels having an outer perimeter with shape and dimensions such that said panel corresponds with the profile shape and dimensions of at least one of the openings in said base and engages the perimeter of said opening in said base to close said opening; and a cover that is made of composite material and that has a shape and dimensions such that the cover engages the perimeter of at least one of said openings in said base.

5. The turndown pad of claim 4 wherein said panels have an interior side, with the interior side of at least one of said panels including at least one rib that provides support against lateral deflection of said panel toward the interior of said turndown pad.

6. A structure for housing electrical and electronic equipment and for supporting a DLC cabinet, a cross-connect cabinet, and a power pedestal inset cabinet in combination, with each of the DLC cabinet, the cross-connect cabinet, and the power pedestal inset cabinet having electrical and mechanical connectors, with the electrical and mechanical connectors of the DLC cabinet, the cross-connect cabinet, and the power pedestal inset cabinet each being differently configured, said structure comprising:

a base that defines a plurality of openings, each of said openings having a perimeter that defines a respective profile shape and size;

a DLC panel made of composite material, said DLC panel having holes therein with said holes being situated at locations in correspondence with the connectors of the DLC cabinet, said DLC panel also having a profile corresponding to the shape of one of said openings in said base, said DLC panel also dimensioned in correspondence with the perimeter of at least one one of said openings in said base;

a cross-connect panel made of composite material, said cross-connect panel having holes therein with said holes being situated at different locations with respect to the DLC panel and in correspondence with the connectors of the cross-connect cabinet, said cross-connect panel also having a profile corresponding to the shape of one of said openings in said base, said cross-connect panel also dimensioned in correspondence with the perimeter of at least one one of said openings in said base;

a power pedestal inset panel made of composite material, said power pedestal inset panel having holes therein with said holes being situated at different locations with respect to the DLC panel and with respect to the cross-connect panel and in correspondence with the connectors of the power pedestal inset cabinet, said power pedestal inset panel also having a profile corresponding to the shape of one of said openings in said base, said power pedestal inset panel also dimensioned in correspondence with the perimeter of at least one of said openings in said base; and a splice hatch cover that is made of composite material and that has a profile and size in correspondence with the perimeter of at least one of said openings in said base.

* * * * *